US010641475B1

(12) United States Patent
Osur et al.

(10) Patent No.: US 10,641,475 B1
(45) Date of Patent: May 5, 2020

(54) LIGHT FIXTURE HAVING MULTIPLE MOVABLE LIGHT SOCKETS

(71) Applicant: Coronet Inc., Totowa, NJ (US)

(72) Inventors: Russell Osur, Totowa, NJ (US); Justin Cohen, Jersey City, NJ (US); Tyler Mark, Fair Lawn, NJ (US); James Krauza, Ridgewood, NJ (US); Federico Collado, Westwood, NJ (US); Jackson Ning, New York, NY (US)

(73) Assignee: CORONET INC., Totowa, NJ (US)

( * ) Notice: Subject to any disclaimer, the term of this patent is extended or adjusted under 35 U.S.C. 154(b) by 0 days.

(21) Appl. No.: 16/351,086

(22) Filed: Mar. 12, 2019

(51) Int. Cl.
*F21V 29/70* (2015.01)
*F21V 14/02* (2006.01)
*G05G 9/047* (2006.01)

(52) U.S. Cl.
CPC ..... *F21V 29/70* (2015.01); *F21V 14/02* (2013.01); *G05G 9/047* (2013.01)

(58) Field of Classification Search
CPC ..... F21V 29/70; F21V 14/02
USPC ..... 362/373
See application file for complete search history.

(56) References Cited

U.S. PATENT DOCUMENTS 3,786,689 A * 1/1974 Houk ..... G05G 9/047 74/471 XY
3,798,436 A * 3/1974 Gross ..... F21V 19/02 362/372
4,375,631 A * 3/1983 Goldberg ..... G05G 9/047 338/128
2002/0136010 A1* 9/2002 Luk ..... F21V 14/02 362/249.02
2004/0076005 A1* 4/2004 Smith, Jr. ..... B60Q 1/0041 362/239
2005/0265024 A1* 12/2005 Luk ..... F21S 10/02 362/231
2006/0002136 A1* 1/2006 Buelow, II ..... F21S 8/02 362/581
2007/0109799 A1* 5/2007 Kaeser ..... F21S 8/02 362/428
2010/0225245 A1* 9/2010 Schenk ..... H05B 37/029 315/294
2012/0307486 A1* 12/2012 Gordin ..... F21V 7/05 362/223
2015/0092406 A1* 4/2015 Holt ..... F21V 14/02 362/231

* cited by examiner

*Primary Examiner* — Bryon T Gyllstrom
(74) *Attorney, Agent, or Firm* — Maginot, Moore & Beck LLP

(57) ABSTRACT

A light fixture has a cover, a joystick, a plurality of light sockets, a movable platform, and a plurality of shafts. The cover has a plurality of openings receiving the plurality of light sockets, each light socket spherically movable within its opening. The joystick is from a first side of the cover, and has a distal end. The movable platform engages the distal end of joystick to move in at least two dimensions responsive to movement of the joystick. Each of the plurality of shafts has a first end spherically engaging the movable platform and a second end rigidly coupled to a corresponding light socket. Spherical movement of the joystick causes movement of the movable platform, and movement of the platform causes movement of the second end of the shafts. Movement of the second end of the shafts causes spherical movement of the light sockets.

20 Claims, 5 Drawing Sheets

LIGHT FIXTURE HAVING MULTIPLE MOVABLE LIGHT SOCKETS

FIELD OF THE INVENTION

The present invention relates generally to light fixtures, and particularly, to light fixtures having multiple light sockets.

BACKGROUND OF THE INVENTION

Because of their power efficiency, and other known advantages, LED lamps are increasingly used for illumination in businesses and residences. LED lamps can be configured in a variety of sizes and formats. Smaller format LED lamps, often a fraction of the size of the standard incandescent bulb, are increasingly popular because they may easily be grouped for scalability to adapt to different lighting needs.

LED lamps in many cases have reflective concave housing to direct the light into a directional beam having a primary beam direction. While the beam from such a housing typically has a conical spreading pattern from the primary axial beam direction, the beam nevertheless focusses more light in the primary beam direction.

In general, recessed lighting fixtures for LED lamps are configured to provide a primary beam direction that is normal to the wall in which the lighting fixture is mounted. Thus, for example, in a typical horizontal ceiling, the recessed lighting fixture provides light having a primary beam direction of vertically downward. Angled ceilings create angled primary beam directions. It is not always desirable, however, to be limited to a primary beam direction that is exactly perpendicular to the wall in which the lighting fixture is mounted.

While standing lamps and desk lamps have mechanisms for allowing adjustment of a primary beam directions, recessed wall light fixtures are not typically adjustable, particularly those having multiple lamps within a single fixture.

There is a need, therefore, for an adjustable light fixture suitable for use as a wall-mounted recessed fixture, and which can receive multiple lamps as can be advantageous for LED light fixtures.

SUMMARY

At least some embodiments of the present invention address the above stated need by providing a light fixture having a cover, and multiple light socket structures that are movable independent of the cover.

A first embodiment is a light fixture having a cover, a joystick, a plurality of light sockets, a movable platform, and a plurality of shafts. The cover has a plurality of openings receiving the plurality of light sockets, each light socket at least partly spherically movable within the corresponding opening. The joystick has an operative end accessible from a first side of the cover, and a distal end. The movable platform operably engages the distal end of joystick to move in at least two dimensions responsive to movement of the distal end of the joystick. Each of the plurality of shafts has a first end spherically engaging the movable platform and a second end rigidly coupled to a corresponding one of the plurality of light sockets. Spherical movement of the joystick causes movement of the movable platform, and movement of the platform causes movement of the second end of the shafts. Movement of the second end of the shafts causes spherical movement of the corresponding light sockets.

A second embodiment is a light fixture having a cover, a plurality of light sockets, a movable platform and a plurality of shafts. The cover has a plurality of openings, each receiving a light socket. Each light socket is configured to receive and support a lamp such that the lamp directs light in a predetermined primary direction. Each light socket is at least partly movable within the opening to such that the lamp can direct light in a plurality of predetermined primary directions while the cover remains stationary. The movable platform is operably coupled to move in at least two dimensions. Each of the plurality of shafts has a first end operably coupled to the movable platform and a second end operably coupled to a corresponding one of the plurality of light sockets. Movement of the platform causes movement of the second end of the shafts, and movement of the second end of the shafts causes movement of the corresponding light socket.

The above-described features and advantages, will become readily apparent to those of ordinary skill in the art by reference to the following detailed description and accompanying drawings.

DETAILED DESCRIPTION

Figure 1:
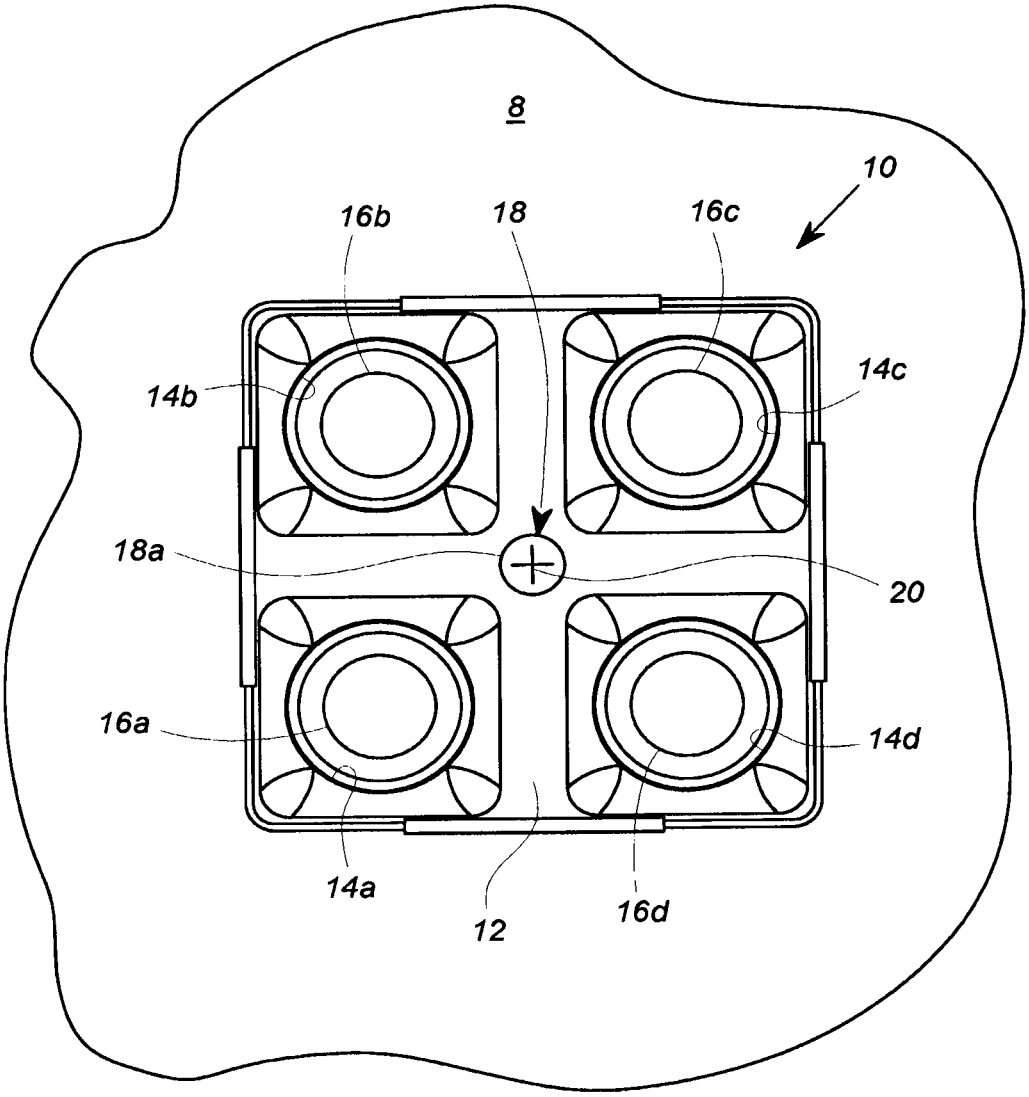
FIG. 1 shows a plan view of a light fixture according to a first embodiment of the invention mounted in a wall.

FIG. 1 shows a plan view of a light fixture 10 according to a non-limiting embodiment of the invention, mounted within a wall 8. In this example, the wall 8 is a ceiling, and the light fixture 10 is arranged such that it directs light into the room from the ceiling wall 8.

The light fixture 10 includes a cover 12 having a plurality of openings 14*a*, 14*b*, 14*c* and 14*d*. Each of the plurality of openings 14*a*, 14*b*, 14*c* and 14*d* receives a respective light socket 16*a*, 16*b*, 16*c*, and 16*d*. Each light socket 16*a*, 16*b*, 16*c*, and 16*d* is configured to receive and support a lamp such that the lamp directs light in a predetermined primary direction. The lamp, not shown in FIG. 1, is preferably an LED lamp having a reflective housing. An exemplary lamp may suitably be a TINA2 lamp, available from LEDil, having a website at www.ledil.com.

Figure 4:
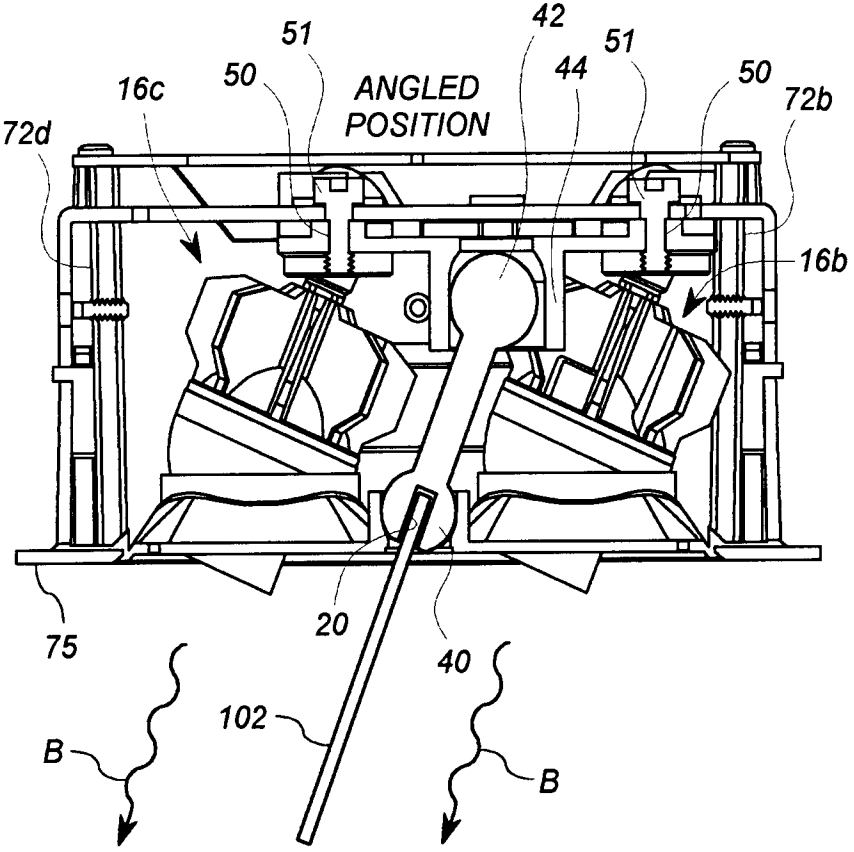
FIG. 4 shows a cutaway of the light fixture of FIG. 1, wherein the light sockets have a second exemplary orientation.
Figure 3:
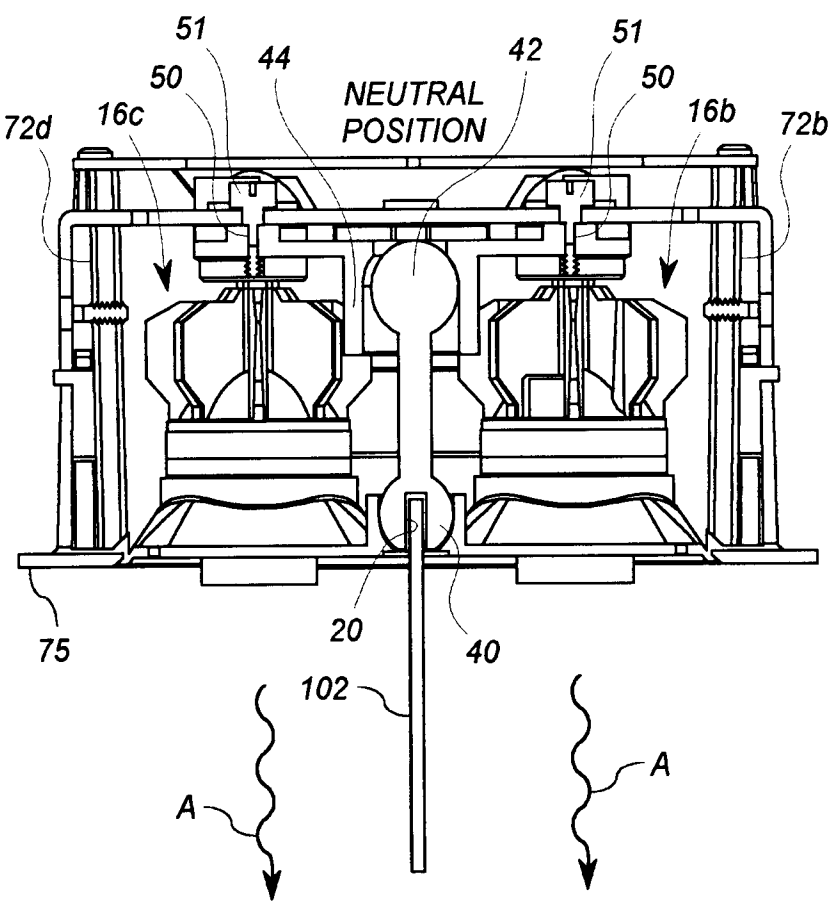
FIG. 3 shows a cutaway of the light fixture of FIG. 1, wherein the light sockets have a first exemplary orientation.

Each light socket 16*a*, 16*b*, 16*c*, and 16*d* is at least partly movable within its respective opening 14*a*, 14*b*, 14*c*, and 14*d* such that the lamp can direct light in a plurality of predetermined primary directions while the cover 12 remains stationary. In this embodiment, the light fixture 10 includes a joystick 18 operably coupled to direct move the light sockets 16*a*, 16*b*, 16*c*, and 16*d* within their respective opening 14*a*, 14*b*, 14*c*, and 14*d*. The operative end of the joystick 18 is externally accessible when the light fixture 10 is installed in the wall 8, such that an operator may change or set the primary direction of the light without removing the light fixture 10 from the wall 8. In this embodiment, the operative end of the joystick 18 includes a slotted opening or other shaped recess 20 to receive a correspondingly shaped end of a tool for adjusting the joystick 18 and hence the primary light direction. FIGS. 3 and 4, discussed further below illustrate how the joystick 18 may be adjusted via a tool 102.

Figure 2:
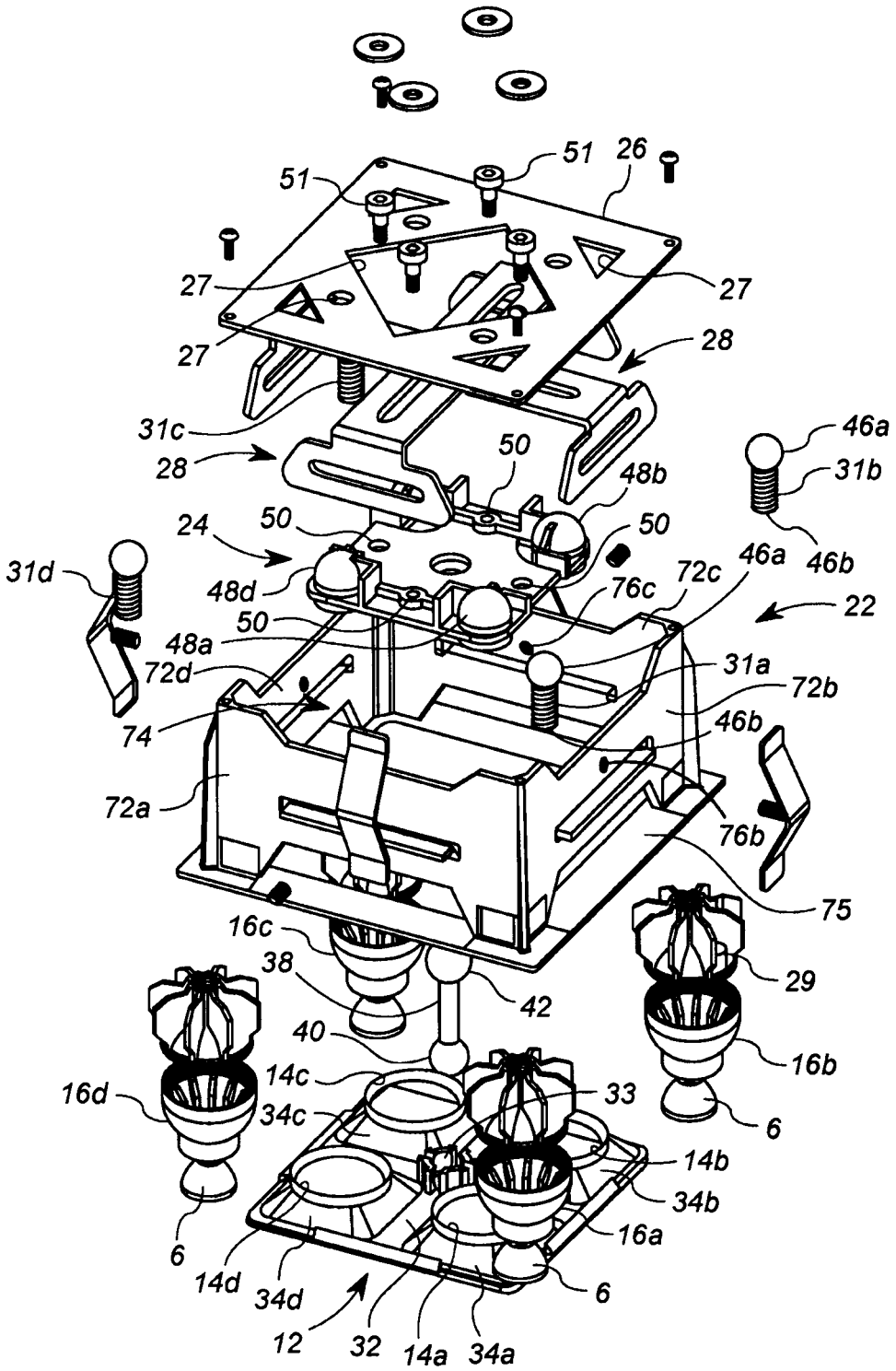
FIG. 2 shows an exploded, perspective view of the light fixture of FIG. 1

The construction of the exemplary light fixture 10 of FIG. 1 is illustrated in further detail in FIGS. 2, 3 and 4. FIG. 2 shows an exploded perspective view of the light fixture 10 apart from the wall. FIG. 3 shows a cross-sectional view of the light fixture 10 of FIG. 1 with the sockets 16*a*, 16*b*, 16*c*, and 16*d* set for a first primary light direction A. FIG. 4 shows the same cross-section view of the light fixture 10 as FIG. 3, but with the sockets 16*a*, 16*b*, 16*c*, and 16*d* set for a second primary light direction B. In the discussion below, the terms horizontal and vertical, and other directional terms (e.g. downward and upward), assume a mounting of the light fixture 10 in a ceiling to light a room, as generally depicted, for example, in FIGS. 3 and 4. However, it will be appreciated that the light fixture 10 can be mounted at any angle. The convention used herein for directional terms is merely for clarity of exposition.

With reference to FIGS. 2, 3 and 4, the light fixture 10 includes, in addition to the cover 12 and the sockets 16*a*, 16*b*, 16*c*, 16*d*, a housing 22, a movable platform 24, a top cover 26, a first slider bar 28, a second slider bar 30, and a plurality of shafts 31*a*, 31*b*, 31*c*, and 31*d*. As discussed above in connection with FIG. 1, the cover 12 has a plurality of openings 14*a*, 14*b*, 14*c*, and 14*d* configured to receive corresponding light sockets 16*a*, 16*b*, 16*c*, and 16*d*. In this embodiment, the cover 12 is in the form of a generally square plate 32 (see also FIG. 1) that includes four interior pedestals 34*a*, 34*b*, 34*c*, and 34*d* forming a two-by-two array on the plate 32. Each of the interior pedestals 34*a*, 34*b*, 34*c*, and 34*d* has at its center a respective one of the openings 14*a*, 14*b*, 14*c* and 14*d*. The plate 32 also includes a receptacle 33 for the joystick 18 at the center of the array of four pedestals 34*a*, 34*b*, 34*c* and 34*d*.

The joystick 18 in this embodiment includes a central shaft 38, a first ball 40 disposed at the operative end 18*a* of the joystick 18 and a second ball 42 disposed at the distal end 18*b* of the joystick 18. The first ball 40 is received into the receptacle 33 and is capable of a limited range of spherical motion therein. Referring specifically to FIGS. 3 and 4, the first ball 40 includes a slot 20 configured to receive the end of the tool 102. As also shown in FIGS. 3 and 4, the tool 102 can be used to manipulate the spherical orientation of the slot (and hence position of the first ball 40).

The movable platform 24 is operably coupled to the distal end (second ball 42) of the joystick 18 to move in at least two dimensions responsive to movement of the distal end 18*b*. To this end, the movable platform 24 includes a receptacle 44 for receiving the second ball 42 to allow spherical movement of the ball 42 within the receptacle 44. In this embodiment, the receptacle 44 includes a centrally located circular opening having a diameter that is less than the diameter of the ball 42. To this end, the receptacle 44 in this embodiment is a boss having a cylindrical interior that receives the ball 42. It will be appreciated that the opening can have other shapes, for example square-shaped, so long it laterally contains the ball 42 and has a structure prevents the ball 42 from passing completely through the movable platform 24.

Each of the plurality of shafts 31*a*, 31*b*, 31*c*, and 31*d*, has a first end 46*a* spherically engaging the movable platform 24 and a second end 46*b* rigidly coupled to a corresponding one of the plurality of light sockets light sockets 16*a*, 16*b*, 16*c*, and 16*d*, such that movement of the platform 24 causes spherical movement of the second end 46*a* of the shafts 31*a*, 31*b*, 31*c* and 31*d*. Such movement of the second end 46*a* of the shafts 31*a*, 31*b*, 31*c* and 31*d* causes spherical movement of the corresponding light socket 16*a*, 16*b*, 16*c* and 16*d*. (See FIGS. 3 and 4).

Figure 5A:
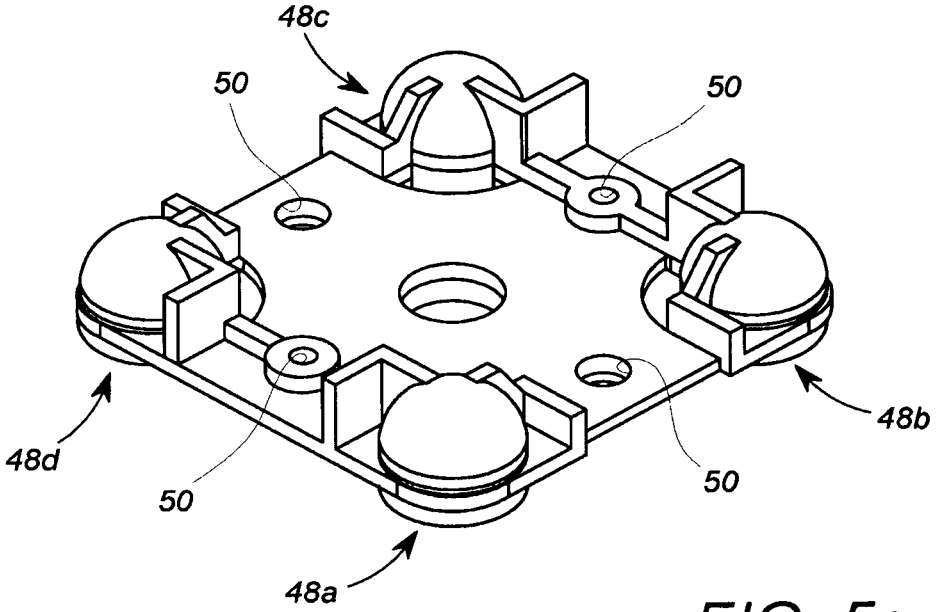
FIG. 5*a* shows a perspective view of the movable platform of the light fixture of FIG. 1
Figure 5B:
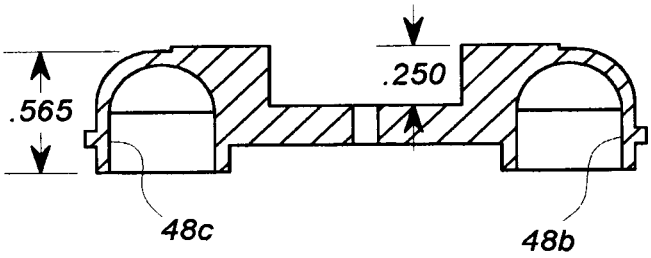
FIG. 5*b* shows a cutaway view of the movable platform of FIG. 5*a;*

To this end, reference is additionally made to FIGS. 5*a* and 5*b*. FIGS. 5*a* and 5*b* show, respectively, a perspective view and a cutaway view of the movable platform 24 in further detail. The movable platform 24 includes four concave depressions 48*a*, 48*b*, 48*c*, and 48*d* disposed in general alignment with corresponding shafts 34*a*, 34*b*, 34*c*, and 34*d* on the plate 32. (See also FIG. 2). The concave depressions 48*a*, 48*b*, 48*c*, and 48*d* face downward, and appear in FIG. 2 (and FIG. 5*a*) as inverse convex features.

Referring to FIGS. 2, 5*a* and 5*b* simultaneously, each of the concave depressions 48*a*, 48*b*, 48*c*, and 48*d* is configured to receive the second end 46*a* of a corresponding one of the shafts 31*a*, 31*b*, 31*c*, and 31*d*. The second end 46*a* of each of the shafts 31*a*, 31*b*, 31*c*, and 31*d* may suitably have a ball or spherical shape to facilitate movement within the corresponding one of the concave depressions 48*a*, 48*b*, 48*c*, and 48*d*.

The movable platform 24 also includes a plurality of threaded holes 50 that receive corresponding threaded fasteners 51, as will be discussed further below. In this embodiment, the platform includes four threaded holes 50, each disposed intermediate each adjacent pair of the concave depressions 48*a*, 48*b*, 48*c*, and 48*d*. In general, the movable platform 24 is moveably coupled to the housing 22 via the first slider bar 28 and the second slider bar 30. More specifically, the first slider bar 28 and second slider bar 30 are operably coupled to the movable platform 24 and to the housing 22 to facilitate controlled movement of the platform 24 within the housing 22.

Figure 6:
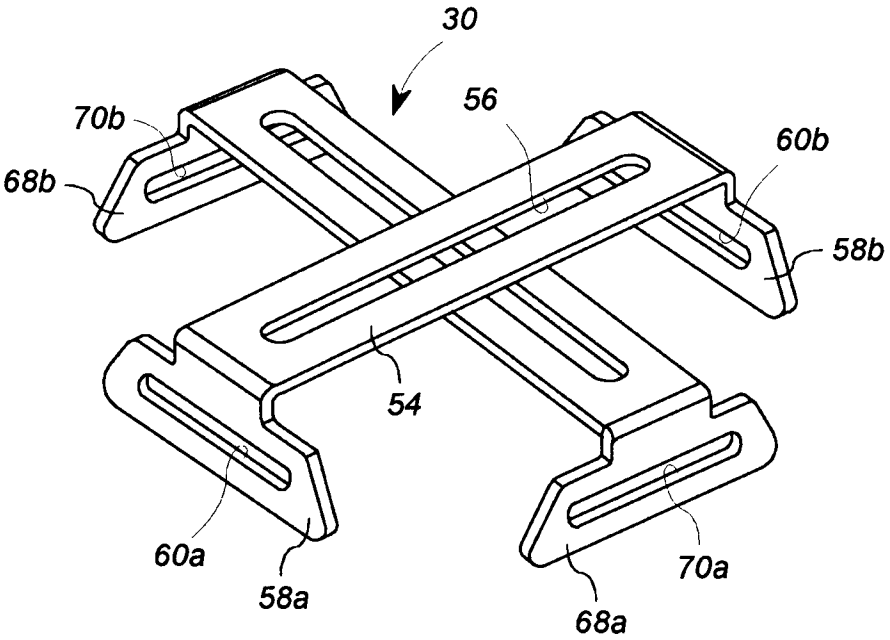
FIG. 6 shows a perspective view of the first and second slider bars of the light fixture of FIG. 1.

FIG. 6 shows in a perspective view of the first slider bar 28 and the second slider bar 30 apart from the rest of the light fixture 10. Referring to FIG. 6, the first slider bar 28 includes an elongate horizontal plate 54 with a linear channel 56 defined through a substantial portion of the plate 54. The plate 54 is disposed horizontally, and extends horizontally, within the housing 22 (see FIG. 2). The linear channel 56 extends horizontally, and defines a vertical opening through the plate 54. Extending downward from either end of the elongate plate 54 are vertical plates 58*a*, 58*b*. Each of the vertical plates 58*a*, 58*b* is disposed vertically, but extends horizontally and perpendicular to the horizontal plate 54. Each of the vertical plates 58*a*, 58*b* includes a corresponding channel 60*a*, 60*b* that extends horizontally and defines a horizontal opening therethrough. As will be discussed below, the channels 60*a*, 60*b* allow the first slider bar 28 to be slidably mounted to the housing 22, and the linear channel 56 allows the movable plate 24 to be slidably mounted to the first slider bar 28.

The second slider bar 30 has a construction that is substantially identical to that of the first slider bar 28. Referring to again to FIG. 6, the second slider bar 30 includes an elongate horizontal plate 64 with a linear channel 66 defined through a substantial portion of the plate 64. The plate 64 is disposed horizontally, and as also shown in FIG. 2 extends horizontally within the housing 22 (in a direction perpendicular to the direction that the plate 54 extends). The linear channel 66 extends horizontally, and defines a vertical opening through the plate 64. Extending downward from either end of the elongate plate 64 are vertical plates 68*a*, 68*b*. Each of the vertical plates 68*a*, 68*b* is disposed vertically, but extends horizontally and perpendicular to the horizontal plate 64. Each of the vertical plates 68*a*, 68*b* includes a corresponding channel 70*a*, 70*b* that extends horizontally and defines a horizontal opening therethrough. As will be discussed below, the channels 70*a*, 70*b* allow the second slider bar 30 to be slidably mounted to the housing 22 (perpendicular to the first slider bar 28), and the channel 66 allows the movable plate 24 to be slidably mounted to the second slider bar 30.

Referring again generally to FIGS. 2, 3 and 4, the housing 22 is a frame that supports the components of the light fixture 10, and is configured to be mounted in a wall of a building. In this embodiment, the housing includes four vertical walls 72*a*, 72*b*, 72*c*, and 72*d* arranged in a rectangular or square configuration, and a bottom flange 75. The four vertical walls 72*a*, 72*b*, 72*c*, and 72*d* define an interior 74. The bottom flange 75 is affixed to the bottom of the four walls 72*a*, 72*b*, 72*c*, and 72*d*, and surrounds the bottom cover 12. For reasons that will become apparent further below, the distance between opposing walls 72*a* and 72*c* is less than the length of the horizontal plate 54 of the first slider bar 28, and the distance between opposing walls 72*b* and 72*b* is less than the length of the horizontal plate 64 of the second slider bar 30.

Each of the walls 72*a*, 72*b*, 72*c*, and 72*d* in includes respective threaded receptacle 76*a* (not shown in FIG. 2), 76*b*, 76*c*, and 76*d* disposed at an intermediate height. To slidably mount the first slider bar 28 to the housing 22, a set screw 78*a* extends through the slot 60*a* of the vertical plate 58*a* into the threaded receptacle 76*a*, and another set screw 78*c* extends through the slot 60*b* of the vertical plate 58*b* into the threaded receptacle 76*c*. The set screws 78*a*, 78*c* are disposed within the slots 60*a*, 60*b* such that the first slider bar 28 can move horizontally. The second slider bar 30 is mounted in a similar manner. A set screw 78*b* extends through the slot 70*a* of the vertical plate 68*a* into the threaded receptacle 76*b*, and another set screw 78*d* extends through the slot 70*b* of the vertical plate 68*b* into the threaded receptacle 76*d*. The set screws 78*b*, 78*d* are disposed within the slots 70*a*, 70*b* such that the second slider bar 28 can move horizontally.

The movable platform 24 is coupled to the first and second slider bars 28, 30 via the threaded fasteners 51. Each of the threaded fasteners 51 in this embodiment is a shoulder screw. Two threaded fasteners 51 extend through the slot 56 and into the corresponding threaded holes 50 in the movable platform 24. The other two threaded fasteners 51 extend through the slot 66 and into the corresponding holes 50. The fasteners 51 are secured in their threaded holes 50, and are slidingly secured within their respective slots 56, 66. In this manner, the first and second slider bars 28 can move with respect to the fasteners 51 along the direction of their respective slots 56, 66. In this embodiment, the shoulder of each of the shoulder screw threaded fasteners 51 aligns within their respective slot 56, 66.

Figure 7:
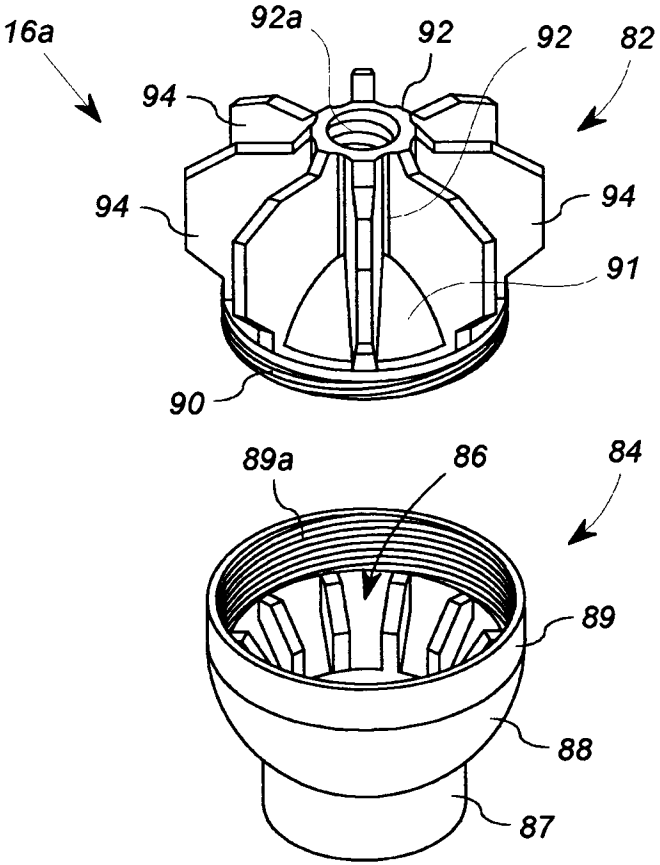
FIG. 7 shows an exploded, perspective view of one of the light sockets of the light fixtures of FIG. 1.

FIG. 7 shows an exploded perspective view of the light socket 16*a*. It will be appreciated that the light sockets 16*b*, 16*c* and 16*d* in this embodiment have a substantially identical structure. With reference to FIG. 7, the light socket 16*a* includes a heat sink 82 and snoot 84. In general, the heat sink 82 and snoot 84 form a housing with an interior 86 for receiving an LED lamp assembly, such as an LEDil TINA2 lamp, not shown in FIG. 7. It will of course be appreciated that the socket 16*a* and other structures of the light fixture 10 of FIGS. 1-4 may be scaled to accept lamp assemblies of other dimensions.

The snoot 84 is in the form of an open bottom cup having a lower cylindrical portion 87, a bulbous portion 88, and an upper cylindrical portion 89. The upper cylindrical portion 89 has a larger diameter than the lower cylindrical portion 87, and the bulbous portion 88 has an arcuately increasing diameter as it extends from the lower cylindrical portion 87 to the upper cylindrical portion 89. Referring to FIGS. 2 and 4, the bulbous portion 88 engages pedestal 34*a* within the opening 14*a* such that the snoot 84 is spherically movable within the opening 14*a*, but is axially and radially stationary. The upper cylindrical portion 89 has a threaded inner wall portion 89*a*.

The heat sink 82 includes a threaded cylindrical portion 90, a domed portion 91, a cylindrical shaft 92, and a plurality of fins 94. The threaded cylindrical portion 90 threadingly engages the upper cylindrical portion 89 of the snoot 84. The threading engagement allows for ease of separation to facilitate access to the interior 86 for lamp placement and replacement. The domed portion 91 extends from the top of the threaded cylindrical portion 90 upward and inward in an arcuate matter to the cylindrical shaft 92. The domed portion 91 includes an opening 29 (not shown in FIG. 7; see FIG. 2) through which wires for conveying power to the lamp may enter the socket 16*a*.

The cylindrical shaft 92 has an interior wall threaded portion 92*a* for receiving the second end 46*b* of the shaft 31*a*. Each of the plurality of fins 94 is a plate-like structure that extends radially outward from the domed portion 91 and cylindrical shaft 92. The plurality of fins 94 extend outwardly in different radial positions with respect to the cylindrical shaft 92. The plurality of fins 94 are configured to convey heat energy from the interior 86 to the area around the fins 94.

As discussed above, the other sockets 16*b*, 16*c* and 16*d* have substantially identical structures. Thus, each of the other sockets 16*b*, 16*c* and 16*d* includes, among other things, a corresponding heat sink having an interior threaded wall portion for receiving threaded second ends 46*b* of one of the respective shafts 31*b*, 31*c* and 31*d*.

It will be appreciated that wires for powering the lamps may be strung in any suitable way. In this example, the top cover or plate 26 includes various openings 27 through which power wires may be fed. The wires are then fed through the housing 22 and into the sockets 16*a*, 16*b*, 16*c* and 16*d* via openings 29.

In operation, a lamp assembly 6 (shown only in FIG. 2) is disposed within the interior 86. With reference to FIG. 2, the light sockets 16*a*, 16*b*, 16*c* and 16*d* are disposed in a first orientation such that the light from the lamp has a first primary (i.e. beam) direction A. A user adjusts the primary direction of the lamp by adjusting the orientation of the light sockets 16*a*, 16*b*, 16*c*, and 16*d* via the joystick 18. To this end, as shown in FIG. 1, the operative end 18*a* is externally accessible when the light fixture 10 is mounted to a wall 8. A user disposes an end of a tool 102, such as a screwdriver, into the slotted opening 20 of the operative end 18*a* as shown in FIG. 3.

In the illustrated example, the user adjusts the angle of the primary light direction A of FIG. 3 to the primary light direction B of FIG. 4. To this end, the user rotates the tool 102 within the slotted opening 20 in the direction of the desired primary light direction B. Rotation of the tool 102 rotates the operative end 18*a* or first ball 40 within the receptacle 33. As noted above, the operative end 18*a* can rotate in a spherical manner, and not merely left and right. It will be appreciated that the "spherical" movement or rotation means movement about a fixed distance from a radius, but not necessarily movement to all points that are at a fixed distance from a radius. In other words, "spherical" movement as described herein is limited, and thus is analogous to ball-and-socket type movement.

Referring again to FIGS. 3 and 4, rotation of the operative end 18 causes the distal end 18*b* of the joystick 18 to move to the right. Because the second ball 42 at the distal end (see FIG. 2) is disposed within the receptacle 44, movement of the second ball 42 causes the platform 24 to move to the right, as shown in FIG. 4. To this end, the force for the distal end 18*b* against the receptacle 44 urges the movable platform 24 to the right. With additional reference to FIG. 2, the threaded fasteners 51 within the first slider bar 28 move freely within the slot 56, because the movement to the right is aligned in this example in parallel with the linear slot 56. However, the threaded fasteners 51 within the second slider bar 30 do not move in parallel to the slot 66, but rather push against the sides of the slot 66. However, movement to the right is in parallel with the slots 70*a*, 70*b* of the second slider bar 30. Thus, the second slider bar 30 can move slidably to the right as the slot travels by the set screws 78*b*, 78*d*.

It will be appreciated that if the tool 102 were adjusted in a direction perpendicular to the adjustment direction illustrated in FIGS. 3 and 4, then the first slider bar 28 would move and the second slider bar 30 would remain stationary. It will be appreciated that the having two perpendicular slider bars 28, 30 configured as shown and described enables two-dimensional movement of the movable plate 24, thus allowing multi-angle adjustment of the light beam generated by the lamps.

Referring again the exemplary movement illustrated in FIGS. 3 and 4, the movement of the distal end 18*b* of the joystick thus moves the movable platform 24 to the right. The concave depressions 48*a*, 48*b*, 48*c*, and 48*d* (see also FIGS. 2 and 5) thereby move to the right. Movement of the depressions 48*a*, 48*b*, 48*c* and 48*d* pulls the second end 46*b* of the shafts 31*a*, 31*b*, 31*c* and 31*d* to the right. Again, the freedom of movement afforded by the ball-and-socket joint of the second end 46*a* of the shafts 31*a*, 31*b*, 31*c* and 31*d* allows the second end 46*b* to be pulled any angle in two dimensions, or in other words, both right and left, and forward and backward.

Movement of the second end 46*b* of the shafts 31*a*, 31*b*, 31*c* and 31*d* translates (via the cylindrical shaft portion 92, domed portion 91, threaded cylindrical portion 90 of the heat sink 82 and upper cylindrical portion 89 of the snoot 84) to rotation of the bulbous portion 88 of the snoot 84 of each of the sockets 16*a*, 16*b*, 16*c* and 16*d* within their respective openings 14*a*, 14*b*, 14*c* and 14*d*. Rotation of the sockets 16*a*, 16*c*, 16*c* and 16*d*, which occurs in a substantially uniform manner, results in the light from the lamps having the second primary light direction B.

The use of the various ball-and-socket type joints allows for the adjustment of the orientation of each light socket 16*a*, 16*b*, 16*c*, and 16*d* without adjusting the entire housing 22 or even the cover 12. The cover 12 may thus remain flush with the wall 8 regardless of the angle of orientation of the light sockets 16*a*, 16*b*, 16*c*, and 16*d*.

It will be appreciated that the light fixture 10 described above may readily be scaled to other sizes, and other numbers of light sockets, by those ordinary skill in the art. The above-described embodiments are merely exemplary, and those of ordinary skill in the art may readily devise their own implementations and modifications that incorporate the principles of the present invention and fall within the spirit and scope thereof.

What is claimed is:

1. A light fixture, comprising:

a cover having a plurality of openings, each of the plurality of openings receiving one of a plurality of light sockets, each light socket at least partly spherically movable within the corresponding opening;

a joystick having an operative end accessible from a first side of the cover, and a distal end;

a movable platform operably engaging the distal end of joystick to move in at least two dimensions responsive to movement of the distal end of the joystick;

a plurality of shafts, each of the plurality of shafts having a first end spherically engaging the movable platform and a second end rigidly coupled to a corresponding one of the plurality of light sockets, wherein spherical movement of the joystick causes movement of the movable platform, and movement of the platform causes movement of the second end of the shafts, and wherein movement of the second end of the shafts causes spherical movement of the corresponding light sockets.

2. The light fixture of claim 1, further comprising a frame, wherein the cover is coupled to the frame, and the platform is moveably coupled to the frame.

3. The light fixture of claim 2, further comprising a first slider bar slidably connected to the frame, and a second slider bar slidably connected to the frame, the first slider bar configured to move in a first direction substantially perpendicular to a second direction of movement of the second slider bar; and wherein the platform is operably coupled to the first slider bar and the second slider bar such that the first slider bar moves in the first direction responsive to movement of the platform in the first direction, and the second slider bar moves in the second direction responsive to movement of the platform in the second direction.

4. The light fixture of claim 3, wherein the first slider bar comprises an elongate plate having a linear channel, and wherein the platform is coupled to the first slider bar via at least a first fastener that extends through the linear channel of the first slider bar.

5. The light fixture of claim 4, wherein the second slider bar comprises an elongate plate having a linear channel, and wherein the platform is coupled to the second slider bar via at least a second fastener that extends through the linear channel of the second slider bar.

6. The light fixture of claim 5, wherein each of the plurality of light sockets comprises an open bottom cup formed of a lower piece and an upper piece defining an interior, the open bottom cup configured to retain a lamp within the interior, and wherein the lower piece and upper piece are configured to be separable.

7. The light fixture of claim 6, wherein the upper piece includes a heat sink having a plurality of heat conductive plates.

8. The light fixture of claim 7, wherein the operative end of the joystick comprises a ball disposed within a corresponding receptacle in the cover, the receptacle in the cover having an exterior opening through which a portion of the ball is externally accessible.

9. The light fixture of claim 8, wherein the ball includes a slotted opening for receiving a corresponding tool, the slotted opening accessible via the exterior opening.

10. The light fixture of claim 8, wherein the upper piece includes a heat sink having a plurality of heat conductive plates.

11. The light fixture of claim 1, wherein each of the plurality of light sockets comprises an open bottom cup formed of a lower piece and an upper piece defining an interior, the open bottom cup configured to retain a lamp within the interior, and wherein the lower piece and upper piece are configured to be separable.

12. The light fixture of claim 1, wherein the operative end of the joystick comprises a ball disposed within a corresponding receptacle in the cover, the receptacle in the cover having an exterior opening through which a portion of the ball is externally accessible.

13. The light fixture of claim 12, wherein the ball includes a slotted opening for receiving a corresponding tool, the slotted opening accessible via the exterior opening.

14. A light fixture, comprising:

a cover having a plurality of openings, each of the plurality of openings configured to receive a light socket of a plurality of light sockets, the light socket configured to receive and support a lamp such that the lamp directs light in a predetermined primary direction, the light socket at least partly movable within the opening to such that the lamp can direct light in a plurality of predetermined primary directions while the cover remains stationary;

a movable platform operably coupled to move in at least two dimensions; and a plurality of shafts, each of the plurality of shafts having a bulbous surface at a first end operably engaging the movable platform and a second end operably coupled to a corresponding one of the plurality of light sockets, wherein movement of the platform causes movement of the second end of the shafts, and wherein movement of the second end of the shafts causes movement of the corresponding light socket.

15. The light fixture of claim 14, wherein each bulbous surface is received within a corresponding concavity of the platform, and wherein the second end is rigidly connected to a corresponding one of the light sockets.

16. The light fixture of claim 15, wherein each light socket includes a rounded bottom portion configured to be movably received within a corresponding one of the openings, and a heat sink coupled above the bottom portion, and wherein the rounded bottom portion includes an interior configured to receive in part a corresponding one of the lamps.

17. The light fixture of claim 16, wherein the heat sink includes a heat sink shaft and a plurality of heat conductive plates extending radially from the heat sink shaft.

18. The light fixture of claim 17, wherein the heat sink shaft is configured to receive and threadingly engage the second end of the corresponding shaft.

19. A light fixture, comprising:

a cover having a plurality of openings, each of the plurality of openings configured to receive a light socket of a plurality of light sockets, the light socket configured to receive and support a lamp such that the lamp directs light in a predetermined primary direction, the light socket at least partly movable within the opening to such that the lamp can direct light in a plurality of predetermined primary directions while the cover remains stationary;

a movable platform operably coupled to move in at least two dimensions; and a plurality of shafts, each of the plurality of shafts having a first end operably engaging the movable platform and a second end operably coupled to a corresponding one of the plurality of light sockets, wherein movement of the platform causes movement of the second end of the shafts, and wherein movement of the second end of the shafts causes movement of the corresponding light socket; and wherein each light socket includes a rounded bottom portion configured to be movably received within a corresponding one of the openings, and a heat sink coupled above the bottom portion, and wherein the rounded bottom portion includes an interior configured to receive in part a corresponding one of the lamps.

20. The light fixture of claim 19, wherein the heat sink includes a heat sink shaft and a plurality of heat conductive plates extending radially from the heat sink shaft.

* * * * *